US010773856B2

(12) United States Patent
Kortman et al.

(10) Patent No.: US 10,773,856 B2
(45) Date of Patent: Sep. 15, 2020

(54) CONTAINER ASSEMBLY HAVING A CELL ASSEMBLY THEREIN AND METHODS FOR FORMING

(71) Applicant: ITB PACKAGING LLC, Holland, MI (US)

(72) Inventors: Calvin Jay Kortman, Holland, MI (US); Aaron Michael Dowling, Holland, MI (US)

(73) Assignee: ITB Packaging LLC, Holland, MI (US)

( * ) Notice: Subject to any disclaimer, the term of this patent is extended or adjusted under 35 U.S.C. 154(b) by 0 days.

(21) Appl. No.: 15/428,445

(22) Filed: Feb. 9, 2017

(65) Prior Publication Data

US 2017/0225835 A1 Aug. 10, 2017

Related U.S. Application Data

(60) Provisional application No. 62/292,890, filed on Feb. 9, 2016.

(51) Int. Cl.
*B65D 25/04* (2006.01)
*B65D 5/49* (2006.01)

(52) U.S. Cl.
CPC ..... *B65D 25/04* (2013.01); *B65D 5/48024* (2013.01); *B65D 5/48026* (2013.01)

(58) Field of Classification Search
CPC .. B65D 25/04; B65D 5/3621; B65D 5/48024; B65D 5/48026; B65D 5/48048; B65D 37/00; B29C 65/00; B29C 66/43
USPC ..... 220/6, 500, 507, 520, 527–529, 666; 229/117.01, 120.02, 120.31; 493/90–91, 493/150
See application file for complete search history.

(56) References Cited

U.S. PATENT DOCUMENTS 145,137 A 12/1873 Wade
3,101,652 A * 8/1963 Imielinski ..... B65D 5/48026 229/120.31

(Continued)

FOREIGN PATENT DOCUMENTS

GB 1216615 12/1973
WO 1998006632 A1 2/1998

OTHER PUBLICATIONS

Se Gyoung Lee, International Search Report, Korean Intellectual Property Office, dated May 18, 2017, 3 pages, Republic of Korea.

(Continued)

*Primary Examiner* — Chun Hoi Cheung
*Assistant Examiner* — Brijesh V. Patel
(74) *Attorney, Agent, or Firm* — McGarry Bair PC

(57) ABSTRACT

A collapsible container assembly includes a folding container having at least two walls pivotable relative to each other at a corresponding corner disposed between the at least two walls, the folding container movable between a collapsed position wherein the at least two walls are disposed adjacent to one another and an extended position where in the at least two walls are spaced from each other, and an inside cellular structure attached to at least a portion of the at least two walls, the cellular structure comprising a plurality of panels forming a cellular structure, the cellular structure further comprising a plurality of cells in both an X and Y direction with respect to the cellular structure, each cell having four cell walls.

20 Claims, 8 Drawing Sheets

(56) References Cited

U.S. PATENT DOCUMENTS

| | | | | | |
|---|---|---|---|---|---|
| 3,580,471 | A * | 5/1971 | Burke | B65D 5/48026 | 229/120.31 |
| 3,834,074 | A * | 9/1974 | Shirouzu | A01G 9/086 | 229/120.31 |
| 3,843,039 | A * | 10/1974 | Brown | B65D 5/48026 | 229/120.31 |
| 5,575,385 | A * | 11/1996 | Zona | B31D 3/0284 | 206/256 |
| 5,597,113 | A | 1/1997 | Bradford | | |
| 5,601,521 | A * | 2/1997 | Plamas Xapelli | B65D 5/48026 | 493/91 |
| 5,772,058 | A | 6/1998 | Staesche | | |
| 5,868,306 | A * | 2/1999 | Wen-Tsan | B65D 1/225 | 206/278 |
| 5,913,473 | A * | 6/1999 | Wang | B42F 7/14 | 229/120.07 |
| 6,196,449 | B1 * | 3/2001 | Chen | B65D 5/4804 | 229/120.26 |
| 8,839,590 | B1 * | 9/2014 | Kortman | E04B 9/34 | 52/144 |
| 2003/0222129 | A1 * | 12/2003 | Williams | B65D 5/48004 | 229/120.31 |
| 2007/0000981 | A1 | 1/2007 | Jacobs | | |
| 2008/0283535 | A1 | 12/2008 | Westrate et al. | | |

OTHER PUBLICATIONS

David Grondin, European Search Report, dated Dec. 17, 2018, 7 pages, Munich, Germany.

* cited by examiner

CONTAINER ASSEMBLY HAVING A CELL ASSEMBLY THEREIN AND METHODS FOR FORMING

CROSS REFERENCE TO RELATED APPLICATIONS

This application claims the benefit of U.S. Provisional Application Ser. No. 62/292,890 filed Feb. 9, 2016, which is incorporated herein by reference in its entirety.

BACKGROUND

Shipping and storage boxes are often provided with a divider that can be inserted into the box for separating individual items from one another. For example, breakable items, such as drinking glasses are often shipped in a box having a divider to prevent the drinking glasses from contacting each other. A divider can also facilitate packing and unpacking of the items within the box by maintaining the items within a defined position relative to one another.

One example of a box and divider system is shown in U.S Publication No. 2008/0283535 to Westrate et al., now U.S. Pat. No. 8,499,956, issued Aug. 6, 2013, which discloses a collapsible container assembly comprising a cell assembly that can be inserted into a box and attached to an interior wall of the box. The box with the cell assembly inside can be folded in a parallelogram motion into a collapsed position which is substantially flat. U.S. Pat. No. 145,137 to Wade discloses an egg carrier comprising a plurality of cells made from strips of pasteboard or thin veneers of wood, which can be used to carry eggs without a surrounding box or container, and which can be folded in a parallelogram motion to a substantially flat condition for transport and storage.

BRIEF SUMMARY

In one aspect, the disclosure relates to a collapsible container assembly includes a collapsible container assembly including a folding container having at four walls, each wall pivotable relative to the adjacent walls at a corresponding corner, the folding container movable between a collapsed position wherein at least two of the four walls are disposed adjacent to one another in parallel and an extended position wherein each of the four walls are perpendicularly arranged relative to each other, and an inside cellular structure attached to at least a portion of each of the four walls, the inside cellular structure comprising a plurality of panels forming a cell assembly, the cell assembly further comprising a plurality of cells in both an X and Y direction with respect to the inside cellular structure, each cell having four cell walls formed by the plurality of panels, at least some of the plurality of cells having two connecting cell walls formed by one of the plurality of panels and another two connecting cell walls formed by an adjacent one of the plurality of panels, each of the connecting cell walls having a curved attachment zone mechanically attached to a curved attachment zone of an adjacent one of the plurality panels. The folding container is further defined by an opposing two of the four corner cells adjacent in the collapsed position, defining a first set of opposing corner cells, wherein the other set of opposing corner cells have a reduced dimension representative of an aggregate size of the attachment zones making up the plurality of panels forming the corner cells such that the attachment zones allow for slack on the inside cellular structure to operably prevent drawing inward of the first set of opposing corner cells adjacent in the collapsed position when the folding container is in the extended position, and wherein the inside cellular structure defines a set of outer perimeter cell walls including the four corner cells, and wherein each of the four corner cells are attached to two of the four walls of the folding container in both the collapsed position and the extended position.

In another aspect, the disclosure relates to a collapsible container assembly including a folding container having four walls movable between a collapsed position and an extended position, and an inside cellular structure comprising a plurality of cells in both an X and Y direction with respect to the inside cellular structure, a series of adjacent continuous panels each mounted to two of the walls of the folding container and to an adjacent wall or an opposing wall of the folding container, each of the series of adjacent continuous panels having a curved attachment portion that is mechanically fastened to an adjacent one of the series of adjacent continuous panels or to one of the four walls of the folding container, whereby the plurality of cells each have four wall portions each formed by the series of adjacent continuous panels between adjacent curved attachment portion. The inside cellular structure defines a set of outer perimeter cell walls having a set of four corner cells, and wherein each of the four corner cells are attached to two of the four walls of the folding container in both the collapsed position and the extended position, an opposing set of two of the four corner cells having a reduced dimension representative of an aggregate size of the curved attachment portions making up the series of adjacent continuous panels between the opposing set of two of the four corner cells such that the curved attachment portions are configured to provide slack on the inside cellular structure in each of the X and Y direction to operably prevent drawing of the folding container inward when the folding container is positioned in the extended position.

DETAILED DESCRIPTION

Figure 1:
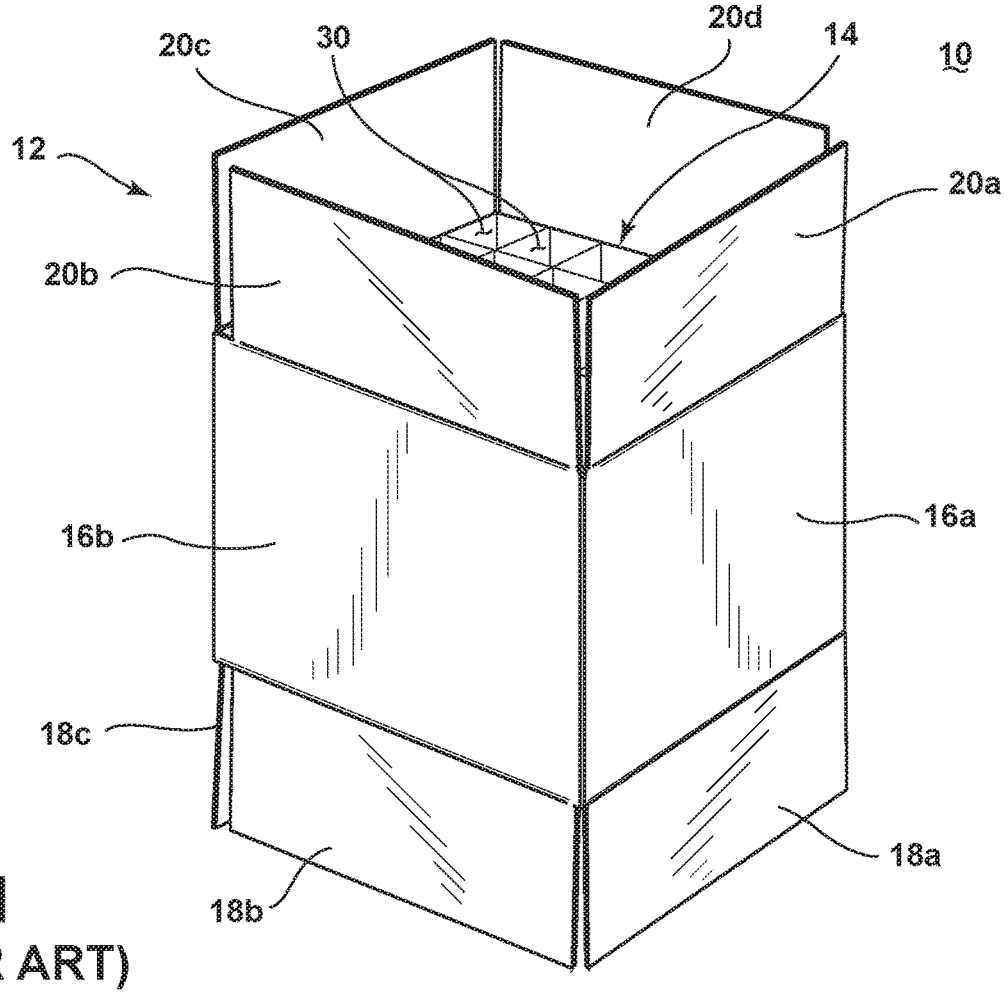
FIG. 1 (PRIOR ART)
FIG. 1 is a prior art perspective view of a partially assembled container assembly according to an embodiment of the invention.
Figure 2:
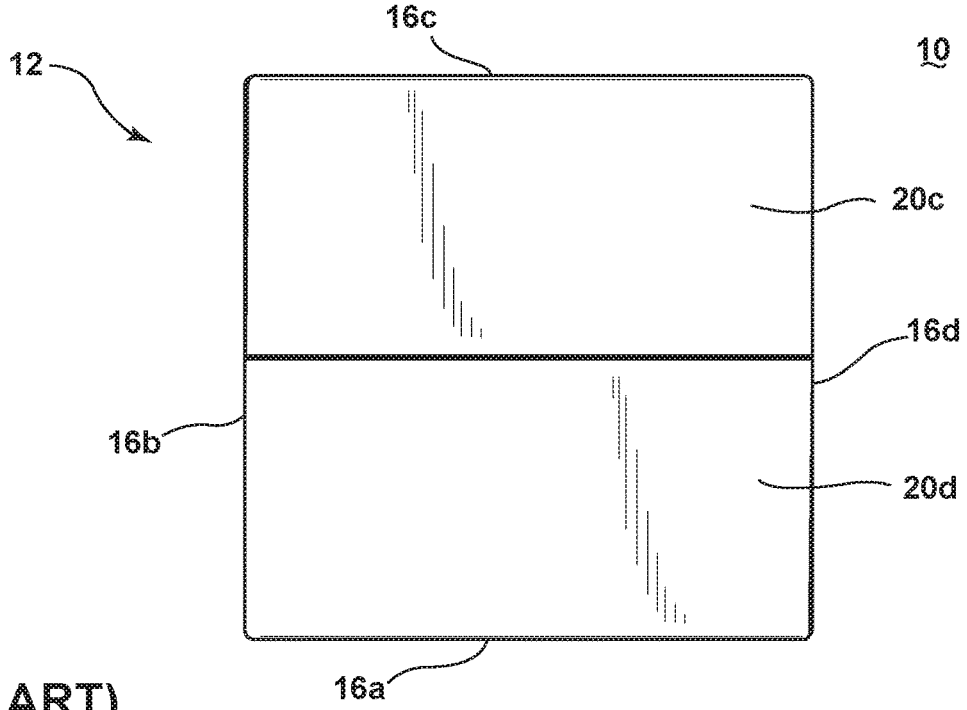
FIG. 2 (PRIOR ART)
FIG. 2 is a prior art diagram top-down view of the container assembly of FIG. 1 in an assembled condition.

FIGS. 1-2 illustrate a container assembly 10 including a container 12 and a cell assembly 14. The container 12 includes four side walls 16*a-d*, four bottom panels 18*a-d* and four cover panels 20*a-d*. While the container assembly 10 is illustrated as a box having a generally square shape, it will be understood that the container assembly 10 can have any desired geometric shape, having any desired dimensions, depending on the intended use of the container assembly 10. It is also within the scope of the invention for the container 12 to include fewer bottom and/or top panels 18*a-d* and 20-*a-d*, respectively.

The container 12 can be made out of any suitable rigid or semi-rigid material such as paperboard, cardboard, wood, chipboard, corrugated paper or plastic.

The cell assembly 14 of the container assembly 10 can comprise an interior cellular structure comprising a plurality of cells 30. An example of an interior cellular structure suitable for use according to an embodiment of the invention is the cellular structures disclosed in U.S. Pub. No. 20080283535 to Westrate et al., filed May 15, 2007, now U.S. Pat. No. 8,499,956, issued Aug. 6, 2013, which is hereby incorporated by reference in its entirety.

As illustrated in FIGS. 3A-H and discussed in detail in U.S. Pub. No. 20080283535 to Westrate et al., now U.S. Pat. No. 8,499,956, issued Aug. 6, 2013, the cell assembly 14 is formed from a plurality of panels 32. Each panel 32 is connected with adjacent panels 32 at a joint 34 using an adhesive or weld, for example, to form cells 30. Each panel 32 is superimposed with the other panels 32 forming the cell assembly 14 and does not intersect with the other panels 32 forming the cell assembly 14. The length and number of panels 32 and the number and spacing of joints 34 between adjacent panels 32 can be varied to provide a cell assembly 14 having any desired number of cells 30. All of the cells 30 can have the same dimensions, as illustrated. Alternatively, the cell assembly 14 can have cells 30 having different dimensions.

Figure 4A:
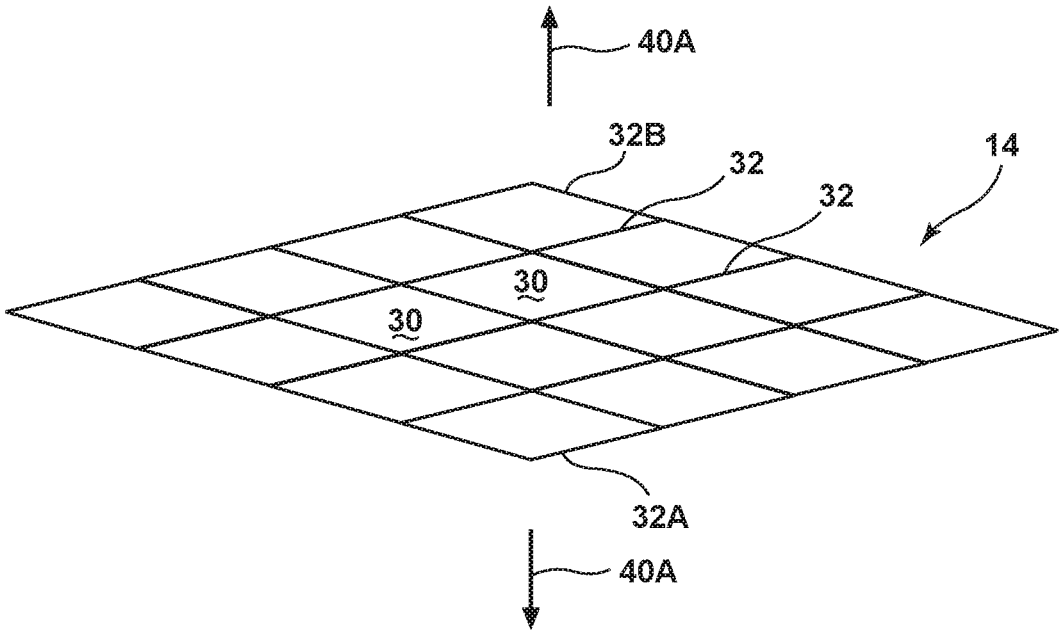
FIG. 4A is a schematic illustration of a cell assembly in a partially collapsed condition according to a third embodiment of the invention.
Figure 4B:
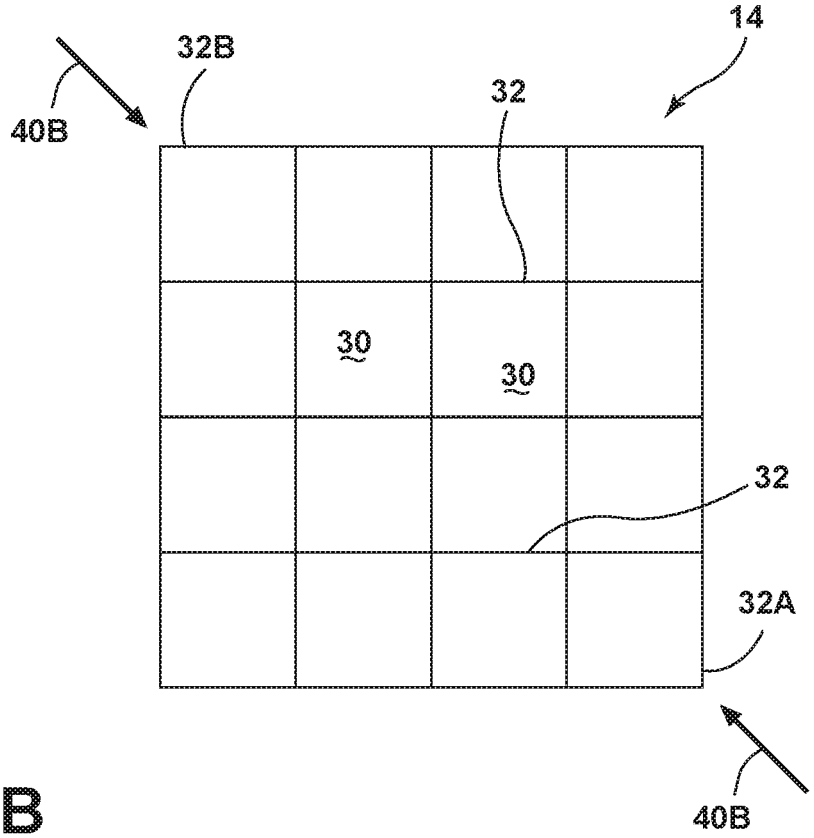
FIG. 4B is a schematic illustration of the cell assembly of FIG. 4A in a fully expanded condition.

As illustrated schematically in FIGS. 4A-B, the stack of superimposed panels 32 forming the cell assembly 14 can be expanded from a partially collapsed condition, illustrated in FIG. 4A, by drawing end panel 32A away from end panel 32B, as illustrated by arrows 40A, to the expanded condition illustrated in FIG. 4B. As the cell assembly 14 is expanded, the superimposed panels 32 form the cells 30, such that each cell 30 has four cell walls, with each cell wall formed from a portion of a single panel 32. As can be seen in FIG. 4B, in the expanded condition, the cell assembly 14 and each cell 30 has a generally rectangular perimeter. The cell assembly 14 can be collapsed in a parallelogram motion to the collapsed condition illustrated in FIG. 4A, by moving panels 32A and 32B towards each other, as illustrated by arrows 40B in FIG. 4B.

Figure 5A:
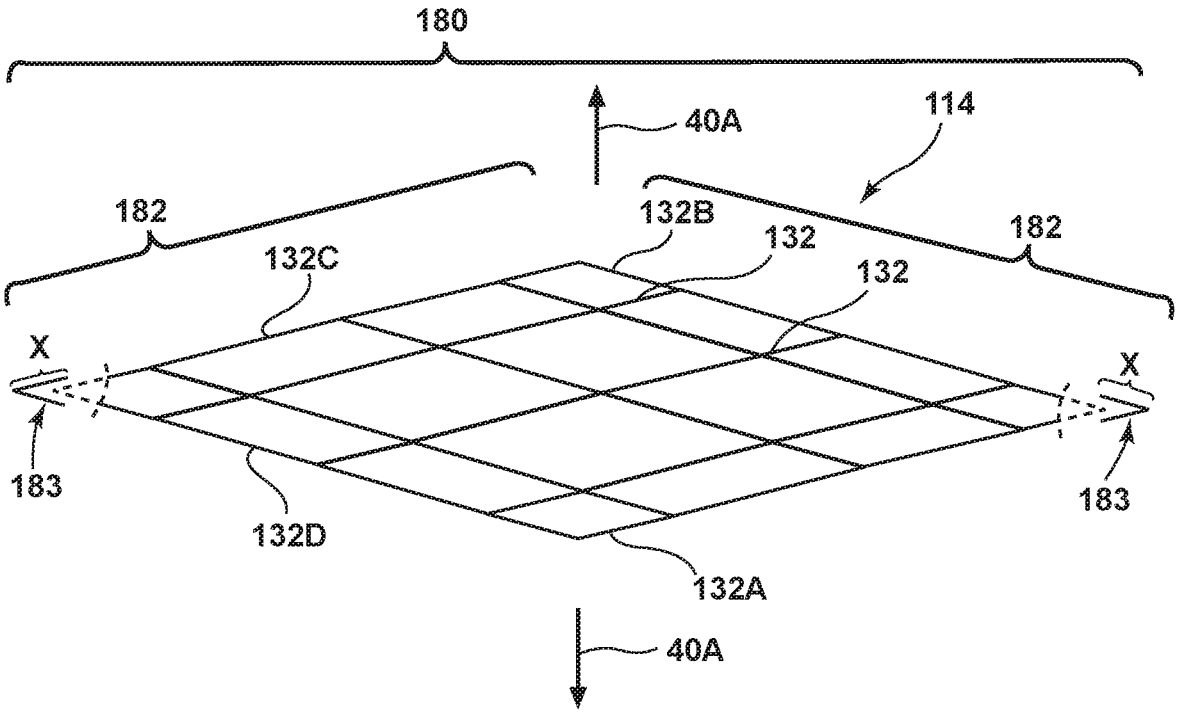
FIG. 5A is a schematic illustration of a cell assembly in a partially collapsed condition according to a fourth embodiment of the invention.
Figure 5B:
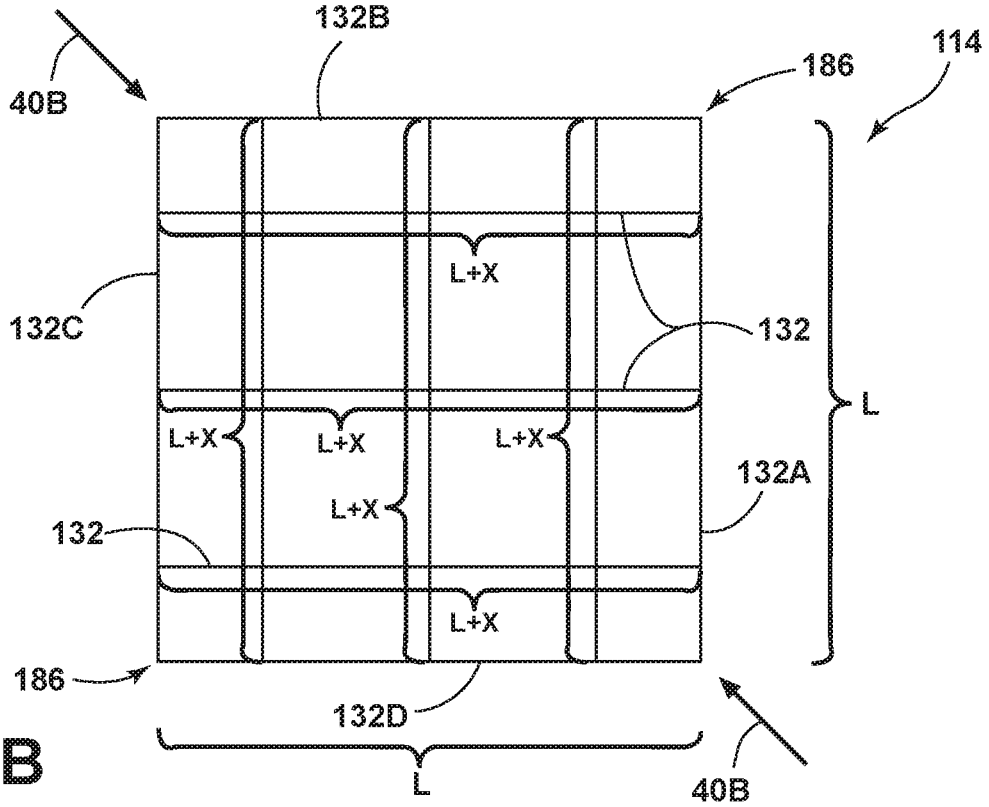
FIG. 5B is a schematic illustration of the cell assembly of FIG. 5A in a fully expanded condition.

Referring now to FIGS. 5A-B, an alternative embodiment of the disclosure can include a cell assembly 114 having a stack of superimposed panels 132, wherein the total length 180 of each span of superimposed panel 132, 132A-D is longer than the embodiment shown in FIGS. 4A-B (wherein 132A-D are the outer or exterior panels and 132 are the inner panels). In this sense, each length (illustrated as "L") of the panel 132, 132A-D is longer by a predetermined dimension (illustrated as "X"). Stated another way, the length 182 of each span of superimposed panels 132, 132A, 132B is equal to L plus X. When in the collapsed condition, the total length 180 of the cell assembly 114 is longer by two times X (2L plus 2X), since the total length 180 includes two superimposed panels 132 in series, and each panel 132 includes an extra length X.

As used herein, the embodiments of the disclosure according to FIGS. 5A-B are "longer" in the sense that they are purposely elongated such that without modification, they would be unable to fit within the container 12, as described below in FIGS. 6A-C. Thus, modification of the cell assembly 114 can be included, such that the alternative cell assembly 114 matches the configuration of the container 12. An X-length portion 183 of the cell assembly 114 can be cut or removed from, for example, each end of the assembly 114, which, in turn, results in a total length 180 of the assembly configured to match the configuration of the container 12. This results in a cell assembly 114 wherein the total length 182 of the outer panels 132A-D have a length L, but the interior panels 132 still have a length of L plus X.

While the portion 183 of the cell assembly 114 is described as cut or removed from, embodiments of the disclosure can include manufacturing, forming, or otherwise configuring the cell assembly 114 described herein, wherein the inner superimposed panels 132 include the length of L plus X, but the exterior or outer panels 132A-D have a length of L.

FIG. 5B illustrates an example of the cell assembly 114 of FIG. 5A in the expanded condition. The panel 132A-D ends 186 where the X-length portion 183 was removed can be coupled to each other, for example, by tape or adhesive, to create an enclosed corner. While the cell assembly 114 illustrated is shown to include the inner superimposed panels 132 in a straight configuration, embodiments of the disclosure are included wherein the inner superimposed panels 132 are not straight between opposing outer panels (for example, between outer panels 132B and 132D, or panels 132A and 132 C; See FIG. 7).

Figure 3A:
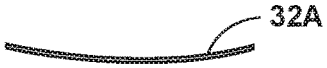
FIGS. 3A-H are a schematic illustration of a method of assembling a cell assembly according to a second embodiment of the invention.
Figure 3B:
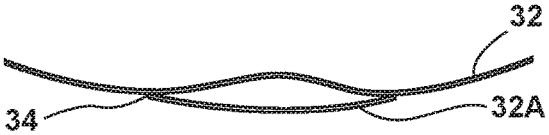
Figure 3C:
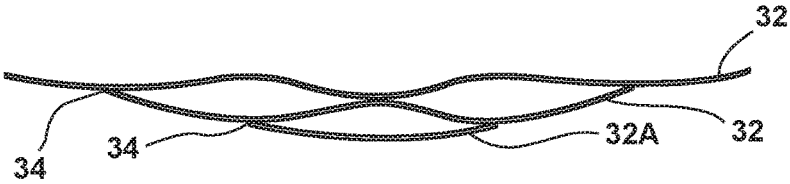
Figure 3D:
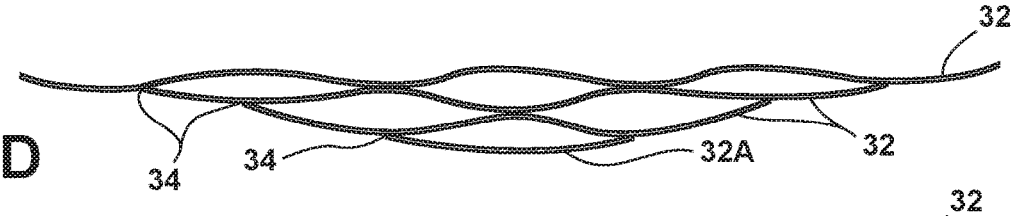
Figure 3E:
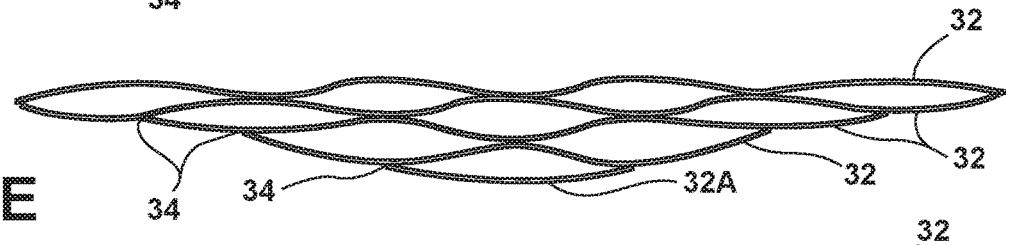
Figure 3F:
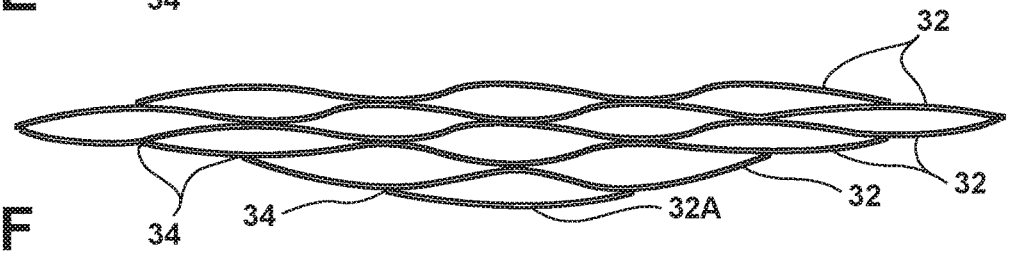
Figure 3G:
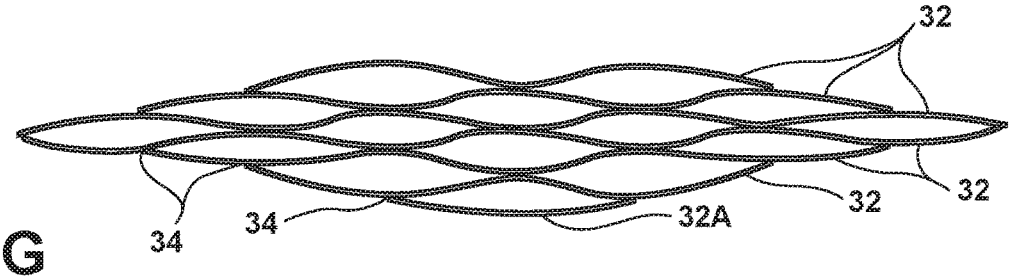
Figure 3H:
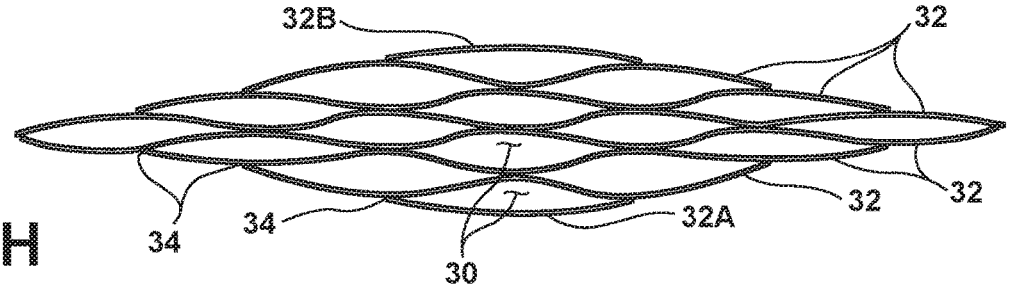
Figure 5C:
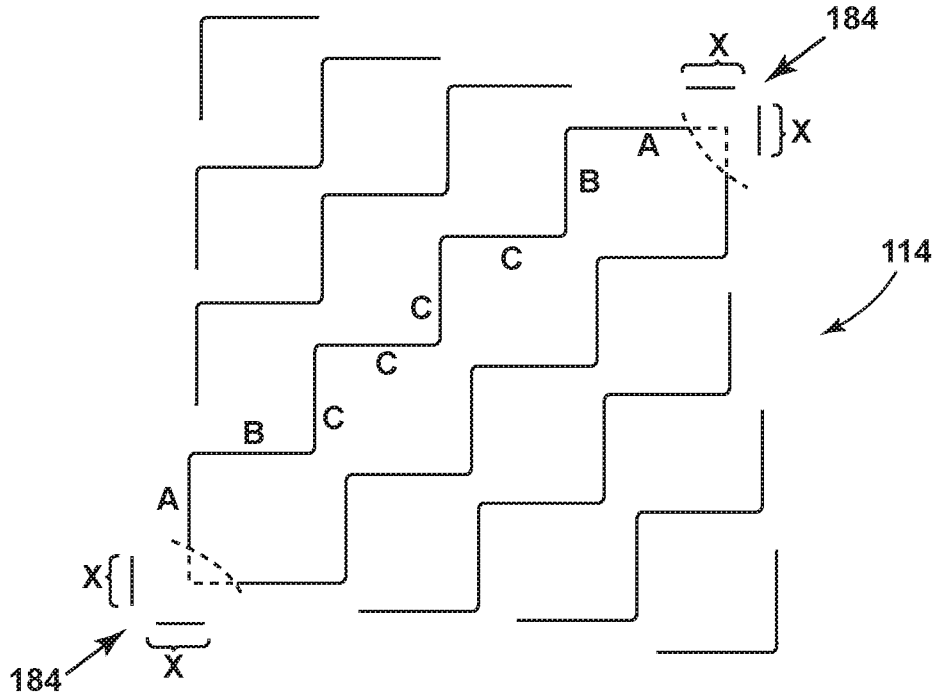
FIG. 5C is a schematic illustration of the exploded panels of the cell assembly of FIG. 5A.

FIG. 5C illustrates the cell assembly 114 of FIG. 5B and cut ends or cut portions 184, wherein the assembly 114 is deconstructed to illustrate the series of adjacent panels, similar to FIG. 3H.

Figure 5D:
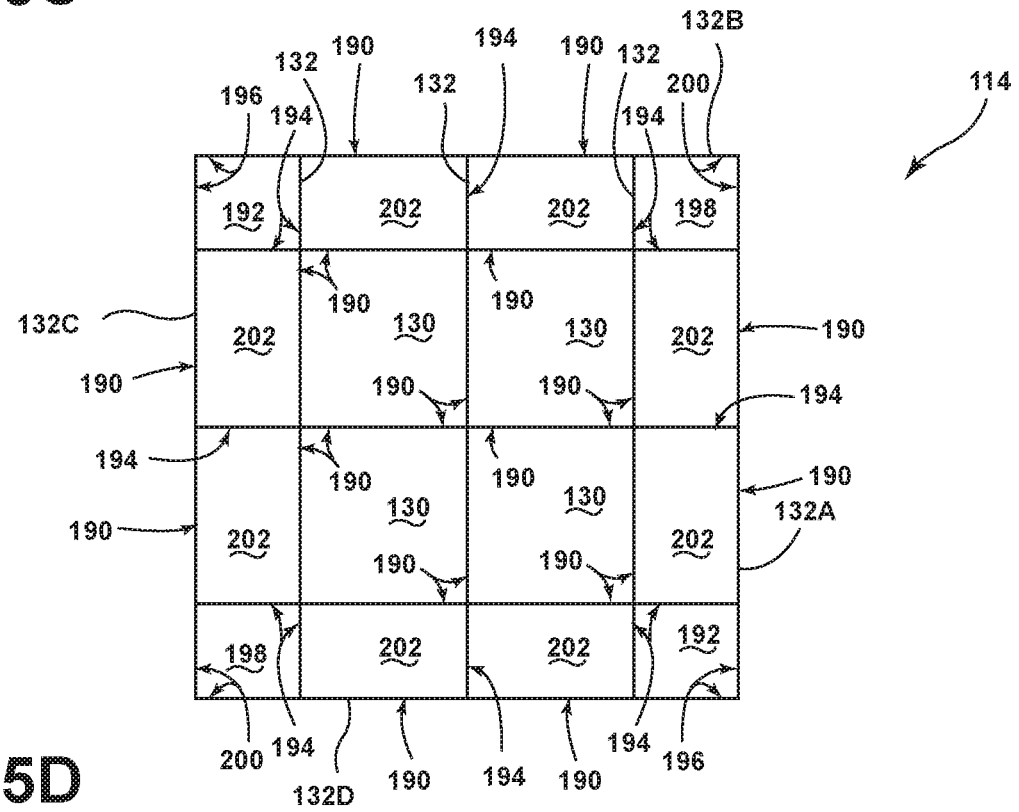
FIG. 5D is a schematic illustration of the various wall lengths and cell configurations of the cell assembly of FIG. 5A.

FIG. 5D illustrates the set of cell dimensions of the resulting cell assembly 114 in the expanded condition, according to embodiments of the disclosure. The cell assembly 114 can include a set of inner cells 130, each having a set of walls of a first length 190. A first set of opposing corner cells 192 can have a first set of walls of a second length 194 and a second set of walls of a third length 196. A second set of opposing corner cells 198 can have a first set of walls parallel with and matching the second length 194, and a second set of walls having a fourth length 200. As shown, the cell assembly can include a perimeter set of cells 202, which do not include the aforementioned corner cells 192, 198, wherein each of the set of perimeter cells 202 can have a first set of opposing walls parallel with and matching the first length 190, and a second set of opposing walls parallel with and matching the second length 194.

Generally, the second length 194 will be greater than the first length 190, which is greater than the fourth length 200. The third length 196 can, for example, be equal with the second length 194, however, alternative embodiments or alternative sizes of the third length 196 can be included, if not limited by the cell assembly 114 configuration or the container 12. While a four by four cell assembly 114 is illustrated, additional cell assembly configurations can be included (e.g. three by three, five by five, six by six, etc.) wherein the inner cells 130, opposing corner cells 192, 198, and perimeter cells 202 adhere with the sizing examples or wall lengths of the first, second, third, and fourth walls 190, 194, 196, 200. Stated another way, any sizing of a cell assembly can include the opposing corner cells 192, 198, and the perimeter cells 202 (any other outer boundary cells that are not the corner cells 192, 198). Additionally, any cells that are not the corner cells 192, 198 or perimeter cells 202 are located internal to the cell assembly 114 structure, and are inner cells 130.

For ease of understanding, a first example of the cell assembly 114 configuration described in FIGS. 5A-D can include the following dimensions:

A container 12 frame has a perimeter lengths of 10" (L) by 10" (L), and the cell assembly 114 is configured to include 4 cells by 4 cells. Each of the panels 132, 132A-D can be sized to include an extra dimensional length (X) of 0.125". The accumulated total lay flat length 180 is 0.25" (2 times X) longer than the perimeter length. Only the 2 outer corner cells 198 can be shortened to fit into the container 12 frame or fixed perimeter length, so removing 0.125" from each end 184 will permit the partition to fit into the frame but will make the opposing outer corner cells 198 smaller than is desired, but often workable. In this example, the set of cells 130, 192, 198, 202 can include configurations wherein the resulting first length 190 is 2.5" (L/4 cells), the second length 194 is 2.625" (L/4 cells+X; 2.5"+0.125"), the third length 196 is 2.625" (L/4 cells+X; 2.5"+0.125"), and the fourth length 200 is 2.375" (L/4 cells−X; 2.5"−0.125"). The total length of an outer perimeter panel 132A-D is 10" (2.375"+2.5"+2.5"+2.625"), while the total length of an inner panel 132 is 10.25" (L+2X; 2.625"+2.5"+2.5"+2.625). A middle panel 32 illustrated in FIG. 5C will have a total length (after cut or removal) of 20" (2.375"+2.625"+2.5"+2.5"+2.5"+2.5"+2.625"+2.375"). This configuration generally results in a cell assembly 114 wherein the inner cells 130, perimeter cells 202, and the first set of opposing corner cells 192 are of a generally uniform size, while the second set of opposing corner cells 198 (e.g. the cut ends 184) are slightly smaller.

Additional examples of the cell assembly 114 configuration described in FIGS. 5A-D can be configured wherein, for example, the extra dimension (X) can be alternatively spread across the first, second, third, and fourth lengths 190, 194, 196, 200 for example, to create cells that are more uniformly sized across the container 12, or wherein at least one of the sets of opposing corner cells 192, 198, or the perimeter cells 202 can be larger than an inner cell 130.

Figure 6A:
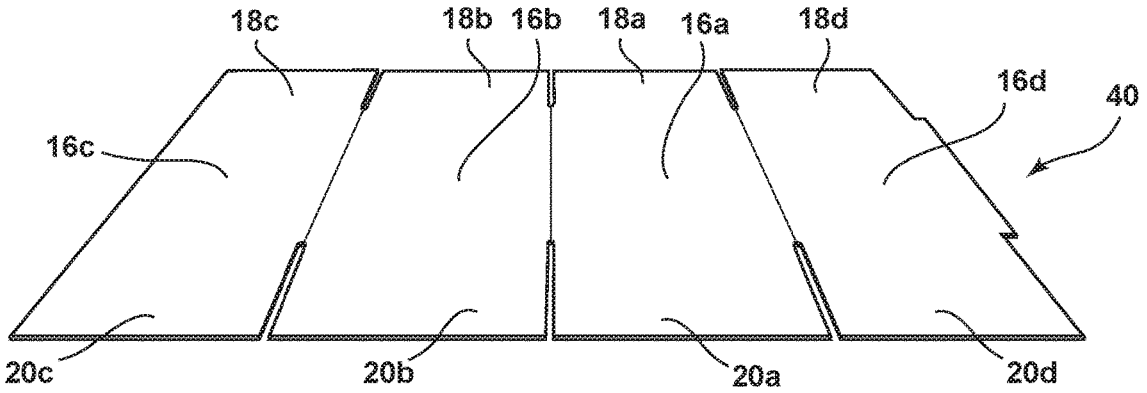
FIG. 6A-C is a schematic illustration of a method of assembling a partially assembled container assembly having a cell assembly therein according to a fourth embodiment of the invention.
Figure 6B:
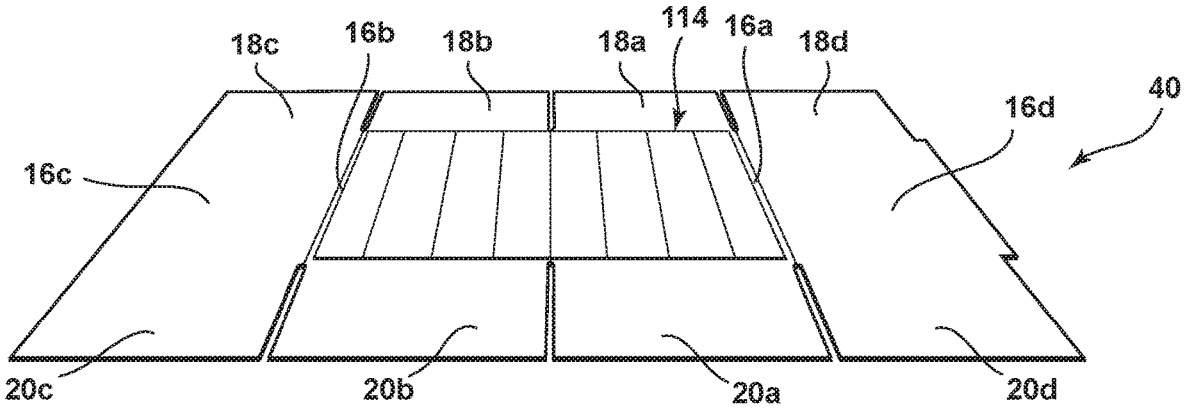
Figure 6C:
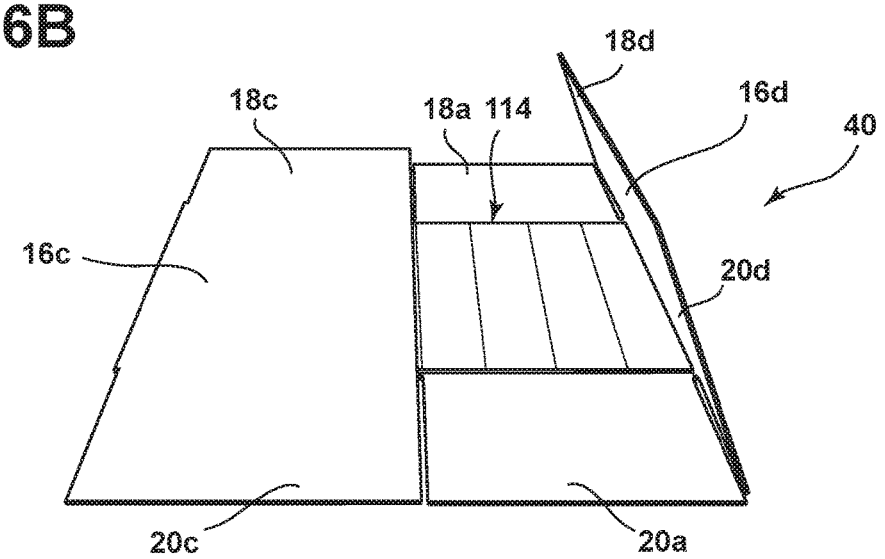

Referring now to FIGS. 6A-C, assembling the container assembly 10 includes providing an unassembled container 12 in the form of a container blank 40, as is known in the art. Adhesive can be applied to the side walls 16*a-d* and a collapsed, unexpanded cell assembly 14 can be placed on top of the adhesive on the middle sidewalls 16*a* and 16*b*, as illustrated in FIG. 5B. Each side wall 16*a-d* can be configured to include a length L, as described above. As illustrated in FIG. 5C, the outer sidewalls 16*c* and 16*d* (total length 2L) can be folded over the cell assembly 114 (having a total length 2L after removing portions, as described above) and adhered to the cell assembly 114. Distal ends of the side walls 16*c* and 16*d* can be coupled, such as with additional adhesive or a weld to form a ready to assemble container assembly 10 comprising a partially assembled container 12 and a cell assembly 114. The bottom and/or cover panels 18*a-d* and 20-*a-d* can be folded over and secured in a closed position, using adhesive, tape or weld, as is known in the art, to fill, ship and store the container assembly 10. While cover panels 18*a-d* and 20*a-d* are shown, embodiments of the disclosure are envisioned wherein only a first set of cover panels (e.g. either 18*a-d* or 20*a-d*) are utilized, or no cover panels are utilized.

Figure 7:
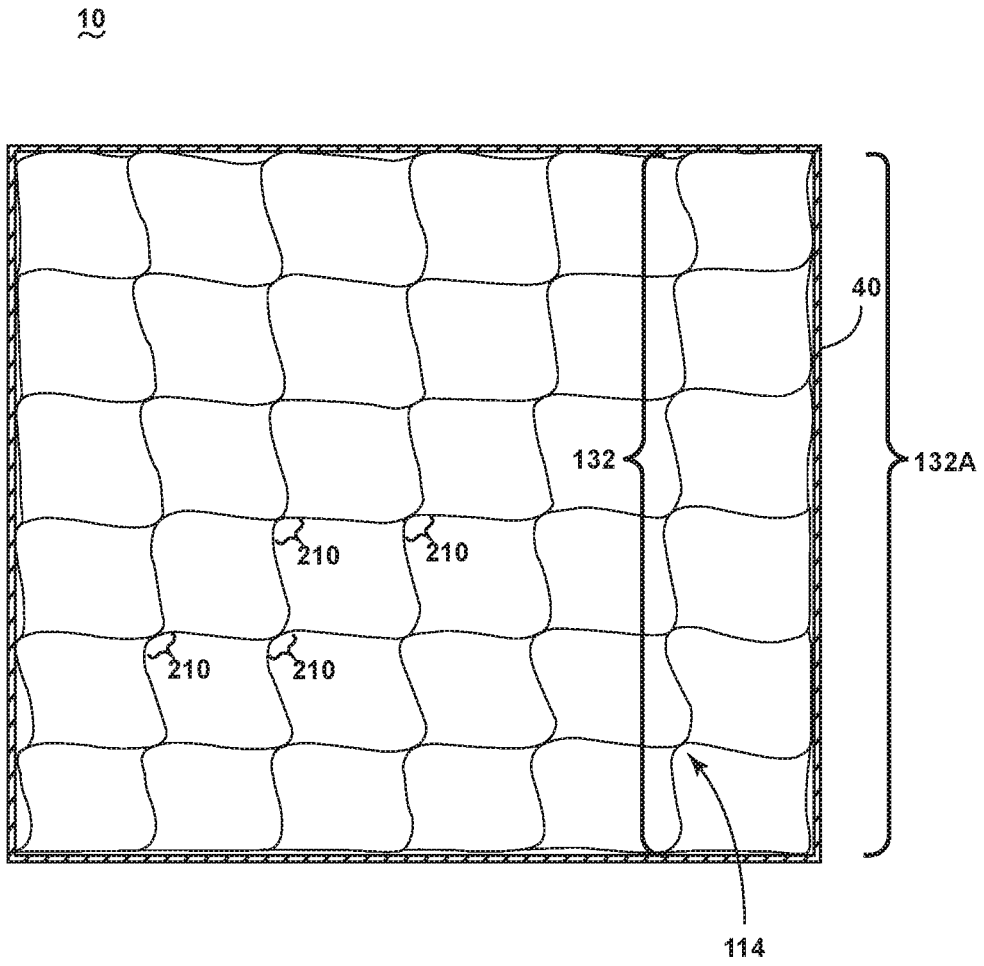
FIG. 7 is a top-down view of the assembled container assembly having the cell assembly, of FIGS. 6A-C, in a fully expanded condition

FIG. 7 illustrates a top-down view of an assembled container assembly 10 having the cell assembly 114 and blank 40 of FIGS. 6A-6C. As shown, the cell assembly 114 can include at least a partial length 210 of the panels 32 where the joints 34 are formed wherein the partial length 210 is a curved or straight portion, and thus, does not form a sharp corner. In this sense, each of the joints 34 require an additional small length of panel 32 to account for the "rounding" as shown. This additional length of panel is provided for or accounted for by the extra dimensional length X, as described above. As the extra length X is utilized over the set of joints, resulting in a longer panel 132 length than a perimeter panel 132A length, as described herein.

Figure 8:
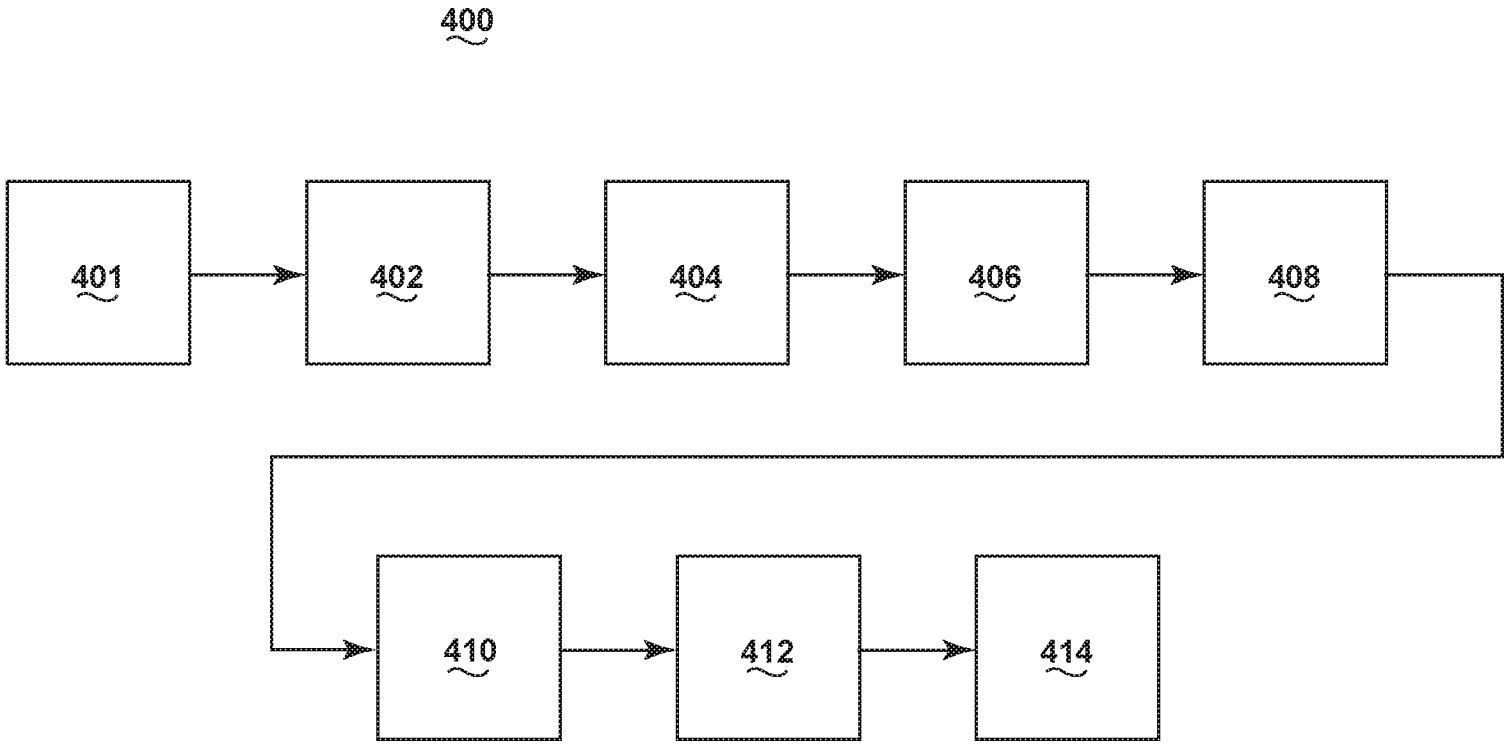
FIG. 8 illustrates a process flowchart for forming the container assembly

Referring now to FIG. 8, a process 400 for forming the container assembly 10 is illustrated. While the process 400 is described in the context of the container assembly 10, it will be understood that the process 400 may be used to form any container assembly 10 in a similar manner. The sequence of steps depicted for this process is for illustrative purposes only, and is not meant to limit the process in any way as it is understood that the steps may proceed in a different logical order or additional or intervening steps may be included without detracting from the invention.

As shown in FIG. 8, the process begins with step 401 with the production of a container blank, which is a sheet of container material, roughly cut into the dimensions required for the container 12. In the following step 402, the container blank is cut, stamped, or trimmed to remove portions of the blank to define the bottom and cover panels 18*a-d*, 20*a-d*, as needed. Next, a first forming process can be performed at step 404, in which the container blank is run through one or more machines which form inward-folding creases for each crease between adjacent sidewalls 16*a-d*, between the sidewalls 16*a-d* and their respective bottom panels 18*a-d*, and between the sidewalls 16*a-d* and their respective cover panels 20*a-d*, as needed. Emblematic crease-forming machine embodiments will comprise of a rolling edge along the container blank, or alternatively a straight or curved edge die pressed into the blank.

Next, in step 404 the cell assembly 114 can be formed by layering and adhering the panels 32, as shown in FIGS. 3A-H. Following the forming of the cell assembly 114, the opposing ends of the assembly 114 can be cut or removed in step 406, as described herein, and illustrated in FIG. 5A. Next, in step 408, adhesive required for the securing the cell assembly 114 to the container sidewalls 16*a-d* and/or adhesive for securing the open ends of the container blank to form the unexpanded container can be applied. In one example, the adhesive is applied in or about the creases at any or all of the intersections of sidewalls 16*a-d*. In another example, the adhesive is applied on any of all of the sidewalls 16*a-d*. Alternatively, adhesive is applied to the surface of the collapsed cell assembly 114. The adhesive may further be applied in any combination including the creases, sidewalls 16*a-d*, or collapsed cell assembly 114. The applying of the adhesive may be formed by depositing adhesive on a surface in parallel or perpendicular lines, as beads, dots, or by depositing the adhesive over a partial or complete surface of the sidewalls 16*a-d* or cell assembly 114. The adhesive for securing the cell assembly 114 and the open ends of the container blank may be the same or different adhesive and may be applied as part of the same step or as different steps in the process 400.

In the next step 410, a collapsed, unexpanded cell assembly 114 can be placed on top of the middle sidewalls 16*a* and 16*b*. Next, in step 412, the outer sidewalls 16*c* and 16*d* can be folded over the cell assembly 114 and adhered to the cell assembly 114 using adhesive that has been applied to the cell assembly 114, creases, and/or the outer sidewalls 16*a-d*.

In step 414, distal ends of the side walls 16*c* and 16*d* can be coupled, such as with additional adhesive or a weld to form a ready to assemble container assembly 10 comprising a partially assembled container 12 and a cell assembly 114. The thus partially assembled, collapsed container 12 can then be expanded and the bottom and/or cover panels 18*a-d* and 20-*a-d* can be folded over and secured in a closed position (if needed), using further adhesive, tape or a weld, for example, to fill, ship and store the container assembly 10 in manner similar to that described above for container assembly 10.

The steps in the process of creating the container 12 may be performed in a multitude of different operations, in any order, by a single or multiple processes.

Various materials known in the art can be used to form the cell assembly 114. Commonly used material, such as Kraft paper, is fairly rigid and has minimal or no stretch. Thus, when the cell assembly 114 is made from Kraft paper and connected with the container 12 as described above, as the cell assembly 114 expands, the non-stretching Kraft paper cannot accommodate for the decreased length in the panels 32 between the joints as a result of the curvature of the expanding panels and the width of the joints 34 as the cell assembly 114 is expanded. The extra dimension X, and configuration of the cell assembly 114, as described herein, allows for the expansion of the cell assembly 114 while providing sufficient or adequate slack on the panels 132 to prevent the drawing of the side walls 16*a-d* of the container 12 inward during expansion. This prevents deformation or uncontrolled collapse of the side walls of the container 12.

Several factors affect the amount of stress applied to the container 12 as the cell assembly 114 expands. Non-limiting examples of these factors include the dimensions of the container, the dimensions of the cells, the type of material the panels are made from, the width of the joint, and the number of joints/number of cells. Increase in the rigidity of the panel material, decrease in the stretch of the panel material, increasing number of cells, and increase in the width of the joint can all increase the amount of stress applied to the container and thus may require different lengths of the dimension X, as well as different lengths of cut or removed portions 184, in order to accommodate the stress.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A collapsible container assembly comprising:

a folding container having at four walls, each wall pivotable relative to the adjacent walls at a corresponding corner, the folding container movable between a collapsed position wherein at least two of the four walls are disposed adjacent to one another in parallel and an extended position wherein each of the four walls are perpendicularly arranged relative to each other; and an inside cellular structure attached to at least a portion of each of the four walls, the inside cellular structure comprising a plurality of panels forming a cell assembly, the cell assembly further comprising a plurality of cells in both an X and Y direction with respect to the inside cellular structure, each cell having four cell walls formed by the plurality of panels, at least some of the plurality of cells having two connecting cell walls formed by one of the plurality of panels and another two connecting cell walls formed by an adjacent one of the plurality of panels, each of the connecting cell walls having a curved attachment zone mechanically attached to a curved attachment zone of an adjacent one of the plurality of panels;

wherein the folding container is further defined by an opposing two of the four corner cells adjacent in the collapsed position, defining a first set of opposing corner cells;

wherein the other set of opposing corner cells have a reduced dimension representative of an aggregate size of the attachment zones making up the plurality of panels forming the corner cells such that the attachment zones allow for slack on the inside cellular structure to operably prevent drawing inward of the first set of opposing corner cells adjacent in the collapsed position when the folding container is in the extended position; and wherein the inside cellular structure defines a set of outer perimeter cell walls including the four corner cells, and wherein each of the four corner cells are attached to two of the four walls of the folding container in both the collapsed position and the extended position.

2. The collapsible container assembly of claim 1 wherein the attachment zones are joints between adjacent cells.

3. The collapsible container assembly of claim 1 wherein the attachment zones are at least one of curved or rounded when the folding container is positioned in the extended position.

4. The collapsible container assembly of claim 1 wherein the attachment zones are mechanically attached by one of adhesive, weld, or tape.

5. The collapsible container assembly of claim 1 wherein the aggregate size of the attachment zones in the X or Y direction equals the reduced dimension.

6. The collapsible container assembly of claim 1 wherein the inside cellular structure includes a first set of outer cells at a perimeter of the cell assembly and a second set of inner cells, different from the first set of outer cells.

7. The collapsible container assembly of claim 6 wherein a cell size of each of the second set of inner cells is uniform.

8. The collapsible container assembly of claim 6 wherein a cell size of each of the second set of inner cells is smaller than the cell size of the first set of outer cells.

9. The collapsible container assembly of claim 1 wherein the attachment zones are configured to provide slack on the cell assembly to operably prevent drawing of the folding container inward when the folding container is positioned in the extended position.

10. The collapsible container assembly of claim 1 wherein the cell assembly includes a first set of panels arranged in the X direction, and wherein the first set of panels further includes a second set of exterior panels adjacent to at least one of the four walls of the folding container, and a third set of inner panels, different from the second set of exterior panels.

11. The collapsible container assembly of claim 10 wherein the third set of inner panels are longer than the second set of exterior panels.

12. The collapsible container assembly of claim 11 wherein the third set of inner panels are longer than the second set of exterior panels by the reduced dimension.

13. The collapsible container assembly of claim 1 wherein the cellular structure is assembled, and wherein the corner cells located at opposite corners of the inside cellular structure are reduced by the reduced dimension.

14. The collapsible container assembly of claim 1 wherein each cell has four enclosing cell walls formed entirely by two of the plurality of panels.

15. A collapsible container assembly comprising:

a folding container having four walls movable between a collapsed position and an extended position; and an inside cellular structure comprising a plurality of cells in both an X and Y direction with respect to the inside cellular structure, a series of adjacent continuous panels each mounted to two of the walls of the folding container and to an adjacent wall or an opposing wall of the folding container, each of the series of adjacent continuous panels having a curved attachment portion that is mechanically fastened to an adjacent one of the series of adjacent continuous panels or to one of the four walls of the folding container, whereby the plurality of cells each have four wall portions each formed by the series of adjacent continuous panels between adjacent curved attachment portion;

wherein the inside cellular structure defines a set of outer perimeter cell walls having a set of four corner cells, and wherein each of the four corner cells are attached to two of the four walls of the folding container in both the collapsed position and the extended position, an opposing set of two of the four corner cells having a reduced dimension representative of an aggregate size of the curved attachment portions making up the series of adjacent continuous panels between the opposing set of two of the four corner cells such that the curved attachment portions are configured to provide slack on the inside cellular structure in each of the X and Y direction to operably prevent drawing of the folding container inward when the folding container is positioned in the extended position.

16. The collapsible container assembly of claim 15 wherein the attachment portions are joints between adjacent layered panels of the inside cellular structure.

17. The collapsible container assembly of claim 15 wherein the inside cellular structure includes a first set of outer cells at a perimeter of the inside cellular structure and a second set of inner cells, different from the first set of outer cells.

18. The collapsible container assembly of claim 17 wherein a cell size of each of the second set of inner cells is smaller than the cell size of the first set of outer cells.

19. The collapsible container assembly of claim 15 wherein the inside cellular structure includes a first set of panels arranged in the X direction, wherein the first set of panels further includes a second set of exterior panels adjacent and parallel to at least one of the folding container walls, and a third set of inner panels, different from the second set of exterior panels, and wherein the third set of inner panels are longer than the second set of exterior panels.

20. The collapsible container assembly of claim 15 wherein the plurality of cells each have four wall portions enclosing the respective cell, and each wall entirely formed by the series of panels.

* * * * *